US007009162B2

(12) United States Patent
Koudelka et al.

(10) Patent No.: US 7,009,162 B2
(45) Date of Patent: Mar. 7, 2006

(54) PHOTOMULTIPLIER POWER SUPPLY WITH PRIMARY AND SECONDARY TRANSFORMER WINDINGS

(75) Inventors: Joseph C. Koudelka, Houston, TX (US); Carlos E. Haramboure, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 77 days.

(21) Appl. No.: 10/706,652

(22) Filed: Nov. 12, 2003

(65) Prior Publication Data

US 2004/0095102 A1 May 20, 2004

Related U.S. Application Data

(60) Provisional application No. 60/425,400, filed on Nov. 12, 2002.

(51) Int. Cl.
*H01J 40/14* (2006.01)

(52) U.S. Cl. ..... 250/207; 250/214 VT

(58) Field of Classification Search ..... 250/207, 250/214 VT, 256, 262, 253; 313/532, 533; 323/355, 359; 166/250.01; 73/152.01; 340/853.1, 340/855.4, 855.8

See application file for complete search history.

(56) References Cited

U.S. PATENT DOCUMENTS

| | | | | |
|---|---|---|---|---|
| 4,409,474 | A * | 10/1983 | Howarth | 250/207 |
| 4,638,164 | A * | 1/1987 | Sonne et al. | 250/366 |
| 4,820,914 | A * | 4/1989 | Allen | 250/207 |
| 4,918,314 | A * | 4/1990 | Sonne | 250/369 |
| 5,021,652 | A * | 6/1991 | Arnold | 250/267 |
| 5,051,572 | A * | 9/1991 | Joseph et al. | 250/207 |
| 5,701,004 | A * | 12/1997 | Nakaya | 250/207 |

FOREIGN PATENT DOCUMENTS

WO WO 9503623 A1 * 2/1995

OTHER PUBLICATIONS

Hamamatsu Photonics Catalog: Photomultiplier Tube, Chapter 7: How to Use Photomultiplier Tubes and Associated Circuits, Mar. 1994, pp. 126-164.

* cited by examiner

*Primary Examiner*—David Porta
*Assistant Examiner*—Davienne Monbleau
(74) *Attorney, Agent, or Firm*—Madan, Mossman & Sriram, P.C.

(57) ABSTRACT

A method and apparatus for providing a photomultiplier power supply having a transformer with multiple secondary windings forming cells that can provide voltage ratios to a photomultiplier element in which the ratios can be adjusted by the method of connection to the cell, by the number of turns in the transformer, or by a combination of both.

16 Claims, 9 Drawing Sheets

400
401
402
404
406
+Vin
GND
405
11
K
1
2
3
4
5
6
7
8
9
DY1
DY2
DY3
DY4
DY5
DY6
DY7
DY8
DY9
1 1/8" SIDE-ON PMT
P
10
SIGNAL OUTPUT

PHOTOMULTIPLIER POWER SUPPLY WITH PRIMARY AND SECONDARY TRANSFORMER WINDINGS

CROSS REFERENCE TO RELATED APPLICATIONS

This patent application is related to and claims priority from U.S. Provisional Patent Application No. 60/425,400 filed on Nov. 12, 2002, Entitled "A Method and Apparatus for a Photomultiplier Power Supply" by J. Koudelka and C. Haramboure, which is hereby incorporated herein by reference in its entirety.

BACKGROUND OF THE INVENTION

1. Field of the Invention

The present invention relates generally to the field of photomultiplier power supplies and in particular to a method and apparatus for providing a photomultiplier power supply having a transformer with multiple secondary windings forming cells that can provide voltage ratios to a photomultiplier element in which the ratios can be adjusted by the method of connection to the cell, by the number of turns in the transformer, or by a combination of both.

2. Summary of the Related Art

Power supplies for the provision of power to a photomultiplier tubes is well known in the art. Photomultipliers are used in a variety of applications, including down hole tools which are deployed in a well bore drilled into the earth. The well bore is typically surrounded by a formation. In the typical down hole tool application, the tool traverses the well bore and the photomultiplier tube is used to determine counts which Typically, when providing a power supply to a photomultiplier tube for operation, a high voltage from 500 to 3000 volts from the power supply is usually applied across the terminals of the photomultiplier tube. The photomultiplier tube terminals, a cathode (K) 201 and anode (P) 202, are provided with a proper voltage gradient set up between the photoelectron focusing electrode (F) 203. A dynode is an electrode in an electron tube that functions to produce secondary emission of electrons. Typically dynodes are provided and depending on tube type, an accelerating electrode is also provided. This voltage gradient can be setup by providing a plurality of independent power supplies 200 as shown in FIG. 1, however, in practice provision of a plurality of power supplies typically not practical.

Thus, in practice, as shown in FIG. 2, the inter stage voltage for each electrode is supplied by providing a network of voltage-dividing resistors 205. In addition, designers will often provide additional Zener diodes 206 connected between the anode and the cathode of the Photomultiplier tube. This typical circuit, as shown in FIG. 2 is commonly referred to as a voltage divider circuit or bleeder circuit. The current $I_b$, flowing through the voltage divider or bleeder circuits shown in FIGS. 2A and 2B is approximately equal to the applied voltage V, divided by the sum of resistor values as follows:

$$I_b=V(R1+R2+R3+R4+R5+R6+R7).$$

The Zener diodes 206 ($D_z$) shown in FIG. 2B are used to maintain the inter stage voltages at constant values for stabilizing the photomultiplier tube operation regardless of the magnitude of the anode current. Capacitors C1, C2, C3 and C4 can be connected in parallel with the Zener diodes serves to minimize noise generated by the Zener diodes. Zener diode noise becomes significant when the current flowing through the Zener diodes is insufficient. In this case, the added capacitance is required as the Zener diode noise can affect the signal-to-noise ratio of the Photomultiplier tube output.

As shown in FIGS. 2A and 2B, the general technique used for voltage divider or bleeder circuits is to ground 208 the photomultiplier tube anode 202 and apply a large negative voltage to the cathode of the photomultiplier tube. This grounding and negative voltage attachment scheme eliminates the potential voltage difference between the external circuit and the photomultiplier tube anode, facilitating the connection of circuits such as ammeters and current-to-voltage conversion operational amplifiers to the Photomultiplier tube circuit terminals. In this Photomultiplier tube anode-grounding scheme, however, one must be careful when bringing a grounded metal holder, housing or magnetic shield case near the bulb of the Photomultiplier tube, or allowing such an element to make contact with the bulb, which can cause electrons in the photomultiplier tube to strike the inner bulb wall. Such an occurrence may possibly produce glass scintillation, resulting in a significant increase in noise and data errors associated therewith.

In a photomultiplier tube anode grounding or cathode grounding scheme in either a DC or pulsed operation, when the light level incident on the photomultiplier tube cathode is increased to raise the photomultiplier tube output current, the relationship between the incident light level on the photomultiplier tube and the photomultiplier tube anode current begins to deviate from an ideal linearity relationship at a certain current levels and eventually, the photomultiplier tube output goes into saturation and is no longer linear.

There are numerous problems associated with all known photomultiplier power supply circuits. These problems are usually encountered in deriving a DC signal output from a photomultiplier tube that is representative of a photomultiplier tube count or the height of the pulses, which is representative of the energy level. Typically counts are determined using a biasing voltage divider network 300 as shown in FIG. 3. The current which actually flows through a bleeder resistor such as R7 302 in the resistor network 304, for example the current 306 flowing across resistor R7, as shown in FIG. 3, equals the difference between the bleeder current $I_b$ 308 and the anode current Ip 306 which flows in the opposite direction through the circuit loop of P–$D_{y5}$–R7–P. Similarly, for the other bleeder resistors in the resistor network, the actual current flowing through a resistor R1–Rn is the difference between the bleeder current $I_b$ 308 and the dynode current $I_{Dyn}$ 310 flowing in the opposite direction through the particular bleeder resistor. The anode current and dynode current flow acts to reduce the bleeder current and the accompanying loss associated with the inter stage voltage supplied becomes more significant in the latter dynode stages which must handle the progressively larger dynode currents. Although the dynode current includes additional current components flowing in the same direction as the bleeder current $I_b$, 308 in the current context, they are of insignificant magnitude for the present discussion.

For the most part, a reduction of the bleeder currents can be ignored if the anode output is of sufficiently small magnitude. However, when the incident light level is increased and the resultant anode and dynode currents are increased in magnitude, the voltage distribution for each dynode will vary considerably. Because the overall cathode-to-anode voltage is kept relatively constant by the provision of a high-voltage power supply voltage, the loss of the inter stage voltage at the latter stages can be and is redistributed to the previous stages so that there will be an increase in the inter stage voltage.

The loss of the inter stage voltage by the multiplied electron current appears most significantly between the last dynode and the photomultiplier tube anode, but the voltage applied between the last dynode and the photomultiplier tube anode does not contribute to the secondary emission ratio of the last dynode. Therefore, the shift in the voltage distribution to the earlier stages results in a collective increase in current amplification. If the incident light level is increased further so that the anode current becomes of large magnitude, the secondary-electron collection efficiency of the photomultiplier tube anode degrades as the voltage between the last dynode and the photomultiplier tube anode decreases.

Typically, two techniques are applied to increase the maximum linear output. First, photomultiplier power supply designers have used lower the bleeder resistor values to increase the bleeder current. Secondly, photomultiplier power supply designers use a Zener diode between the last dynode and the anode and if necessary between the next to last and second to last stage as well. If the photomultiplier power supply bleeder resistors are located close to the photomultiplier tube, the heat emanating from their resistance may raise the photomultiplier tube temperature, leading to an increase in the undesirable dark current and can induce possible fluctuations in the output signal of the photomultiplier power tube. Furthermore, since design technique requires a high-voltage power supply with a large capacity, it is inadvisable to increase the bleeder current more than necessary. To solve the above problems in applications where a high linear photomultiplier tube output is required, individual power supplies may be used in place of the bleeder resistors at the last few stages of a photomultiplier tube power source. With the Zener diode technique for photomultiplier tube power source design, if the bleeder current becomes insufficient, undesirable Zener diode noise will be generated from the Zener diode, possibly causing detrimental effects on the linearity and associated accuracy output of the photomultiplier tube. Because of this potential inaccuracy in signal from the photomultiplier tube output, it is essential to increase the bleeder current for the photomultiplier tube to an adequate level and connect a ceramic capacitor having an acceptable frequency response in parallel with the Zener diode for absorbing the possible noise in the circuit.

When a photomultiplier tube is pulse-operated, by way of providing a bleeder circuit, such as the circuit shown in FIG. 2A, the maximum linear output of the photomultiplier tube is limited to a fraction of the bleeder current just as in the case of DC voltage operation. To ameliorate or prevent this problem, decoupling capacitors can be connected to the last few stages. These added decoupling capacitors can also supply the photomultiplier tube with an electric charge during the pulse duration, thereby restraining or mitigating the voltage drop between the last dynode and the anode of the photomultiplier tube, thus resulting in a significant improvement in pulse mode operation linearity. Even with the decoupling capacitors, however, the output of the photomultiplier tube deviates form the desired linear range when the average output current exceeds $1/20^{th}$ to $1/50^{th}$ of the bleeder current. In particular, care is required at high counting rates even when the output peak current is low.

As discussed above, typical known photomultiplier power supplies typically utilize resistor ladders to provide voltage to a photomultiplier tube. The resistor ladder is undesirable because of their associated high-power consumption and untenable difficulties in providing some voltage distribution ratios. Moreover, typically known photomultiplier power supply designs require a complex transformer construction, making them difficult to manufacture.

As shown in FIG. 4, a known circuit design is shown in which a Cockcroft-Walton voltage multiplier circuit 400 is shown in which an array of diodes 401 are connected in series. Capacitors 402 are connected in series long each side of the alternate connection points. When a reference voltage V 406 is placed at the input 404, this circuit provides voltage potentials of 2V or 3V and so on at each connection point. Therefore, the power supply circuit shown in FIG. 4 functions much like a conventional resistive bleeder circuit. The Cockcroft-Walton voltage multiplier circuit, however, is inordinately complex. Thus, the circuit of FIG. 4, while known, requires additional parts and is undesirably difficult to manufacture.

Thus, there is a need for a less complex photomultiplier power supply design that provides a lower power consumption voltage ratio conversion circuit that also provides good linearity and is easy to manufacture. Low power consumption is critical in many environments, such as down hole tools, where power can be limited and power conservation can be critical. There is also a need for a photomultiplier power supply design that less sensitive to high temperature environments; such as for use in oil field services operations in a down hole environment such as a wire line or monitoring while drilling applications which subject equipments and power supplies to extreme subterranean temperatures.

SUMMARY OF THE INVENTION

The present invention addresses the shortcomings of the related art described above. The present invention provides an apparatus and method for supplying voltage to a photomultiplier tube. The present invention requires less space and fewer components than known photomultiplier tube power supplies discussed above or known to the inventors. In the present invention, approximately one-half of the diodes and capacitors used in known photomultiplier power supply designs are required in the photomultiplier power supply of the present invention. The present invention provides for inherently fixed distribution of voltage ratios between photomultiplier tube terminals. The present invention provides fixed transformer voltage ratios, thereby avoiding the undesirable characteristics of multiplier ladders and resistor ladders used in prior known photomultiplier power supplies. The present invention does not produce a photomultiplier gain shift when a count rate increases as in known designs using resistor ladder because there is not a resistor network used in the design of the present invention. The present invention also consumes very little power. The present invention facilitates the provision of virtually any voltage distribution ratio. The present invention is easy simpler than known designs and therefore is easier to manufacture having a simple transformer construction.

BRIEF DESCRIPTION OF THE FIGURES

For detailed understanding of the present invention, references should be made to the following detailed description of the preferred embodiment, taken in conjunction with the accompanying drawings, in which like elements have been given like numerals, wherein.

DETAILED DESCRIPTION OF A PREFERRED EMBODIMENT

Figure 1:
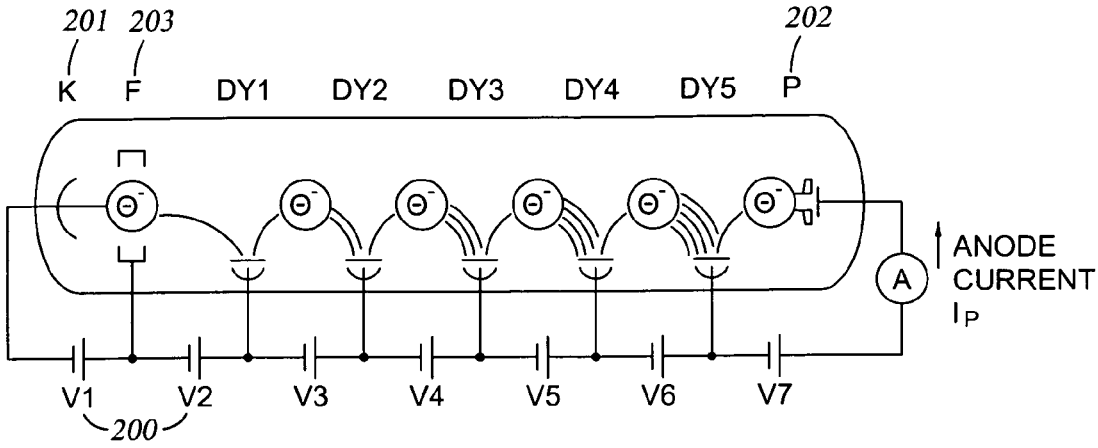
Fig. 1 (PRIOR ART)
FIG. 1 is a known schematic illustrating photomultiplier tube operation.
Figure 2A:
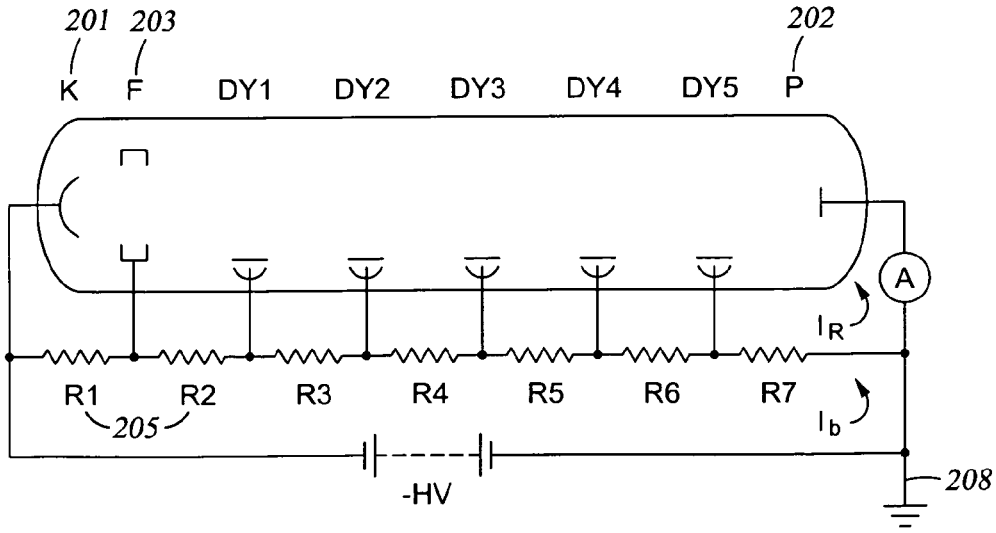
Fig. 2A (PRIOR ART)
FIGS. 2A and 2B illustrate a known bleeder circuit.
Figure 2B:
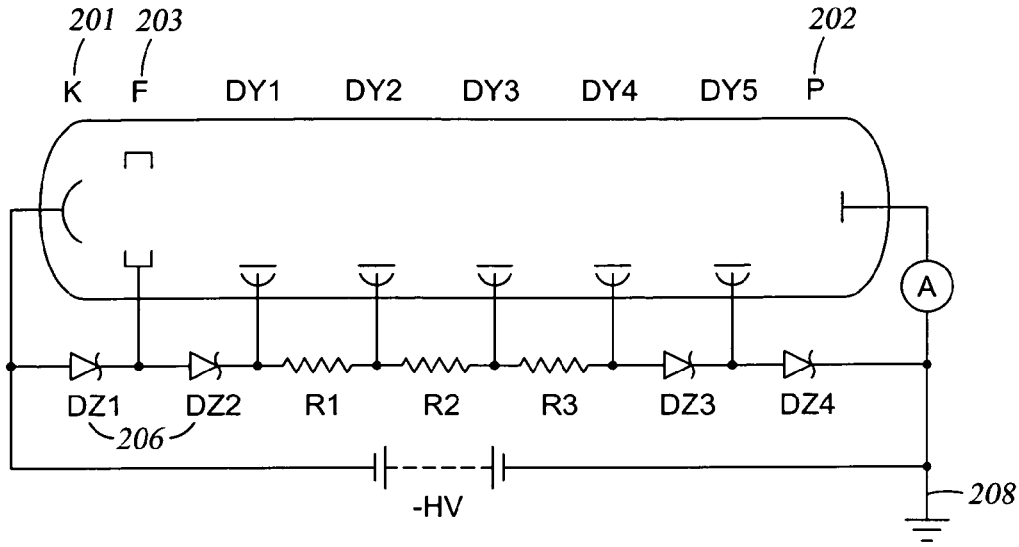
Fig. 2B (PRIOR ART)
Figure 3:
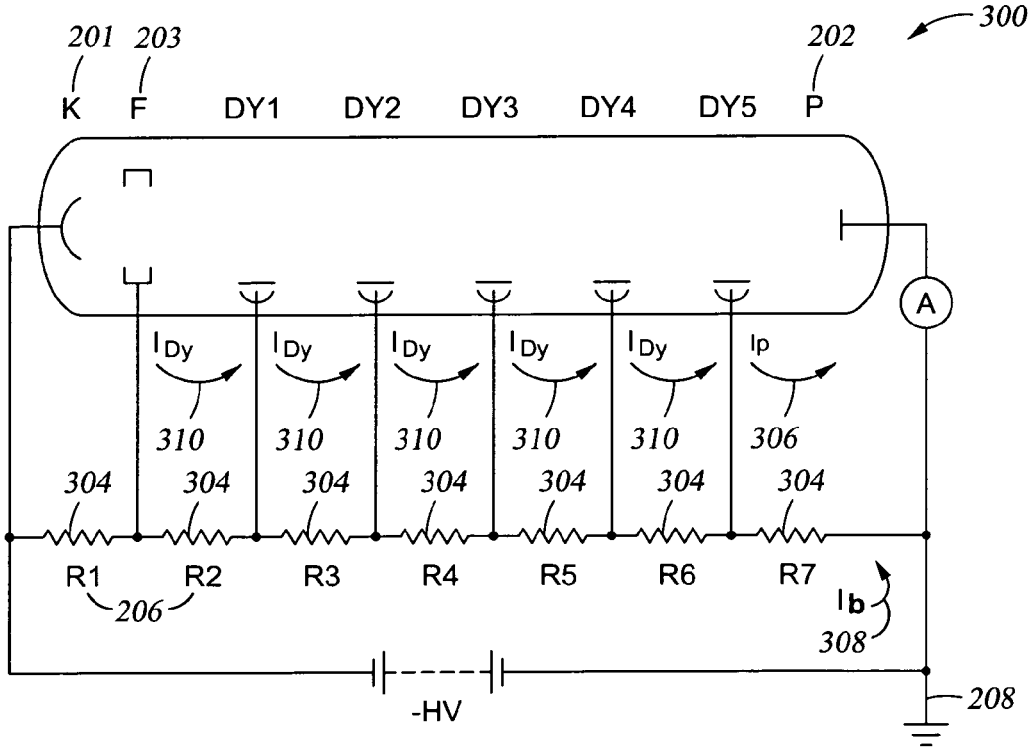
Fig. 3 (PRIOR ART)
FIG. 3 illustrates a basic known operating circuit for a photomultiplier tube.
Figure 4:
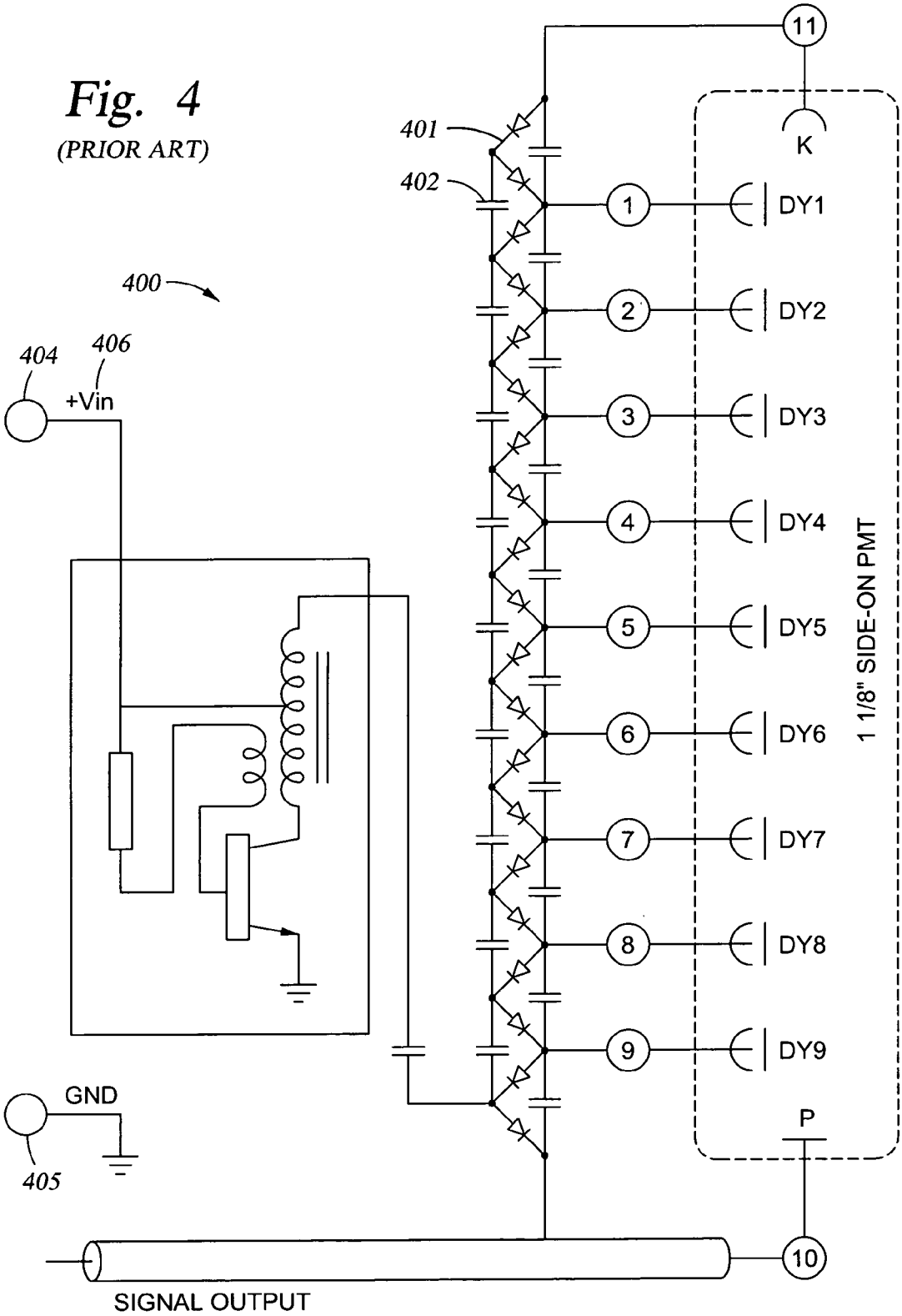
Fig. 4 (PRIOR ART)
FIG. 4 is an illustration of a known Cockcroft-Walton voltage multiplier circuit.
Figure 5:
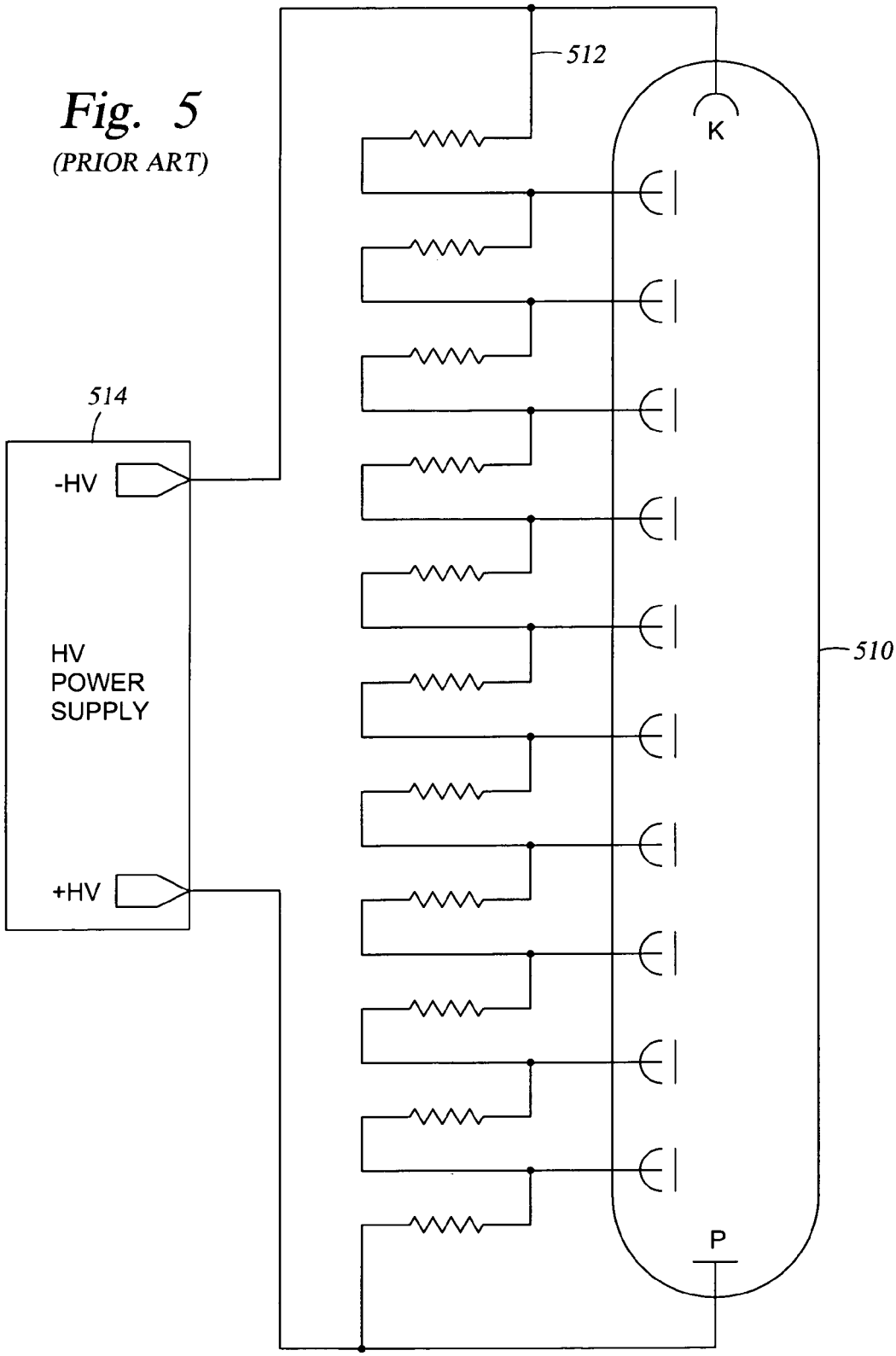
Fig. 5 (PRIOR ART)
FIG. 5 is an illustration of a known photomultiplier power supply circuit design.
Figure 6:
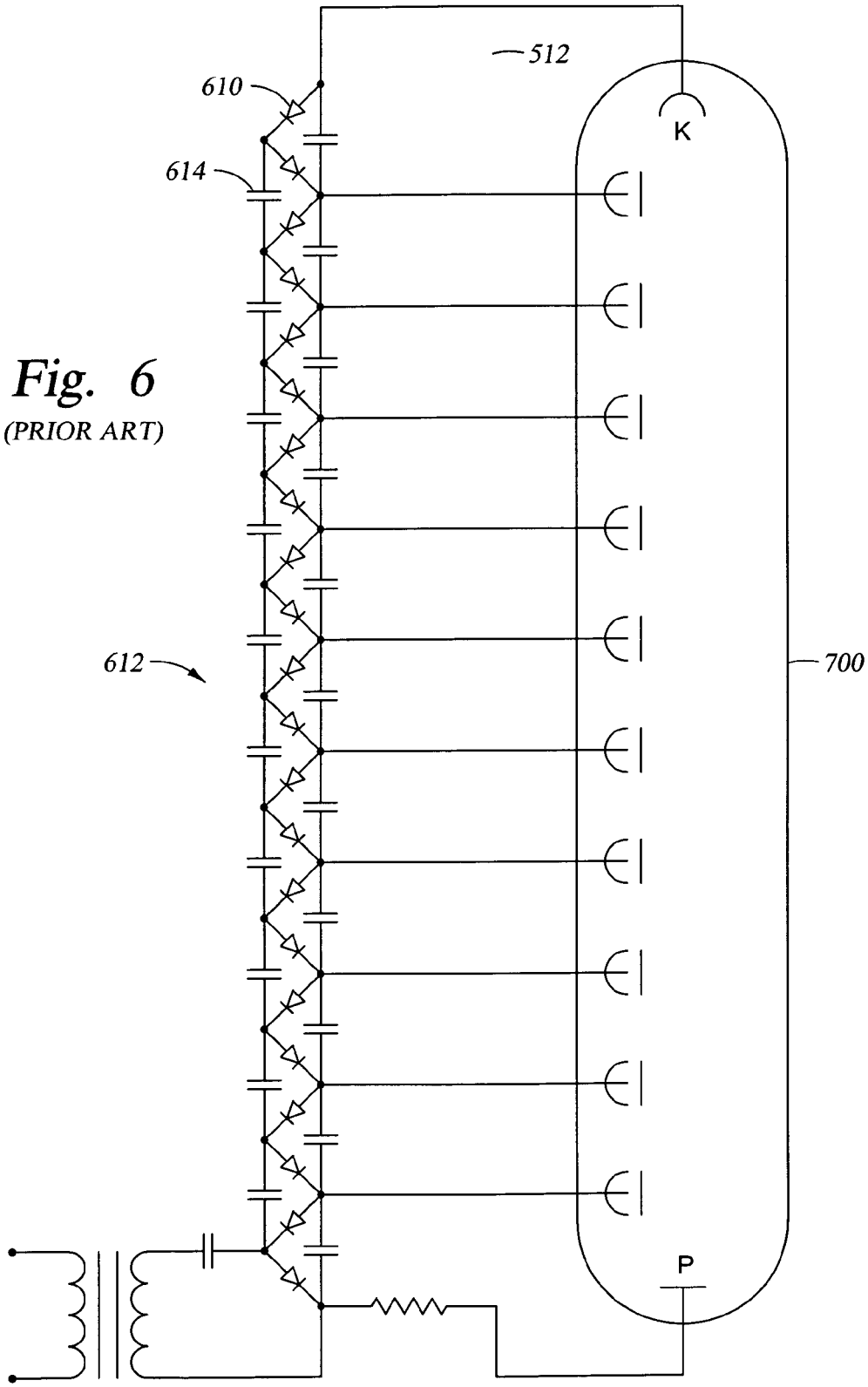
Fig. 6 (PRIOR ART)
FIG. 6 is an illustration of a known photomultiplier power supply circuit design.
Figure 7:
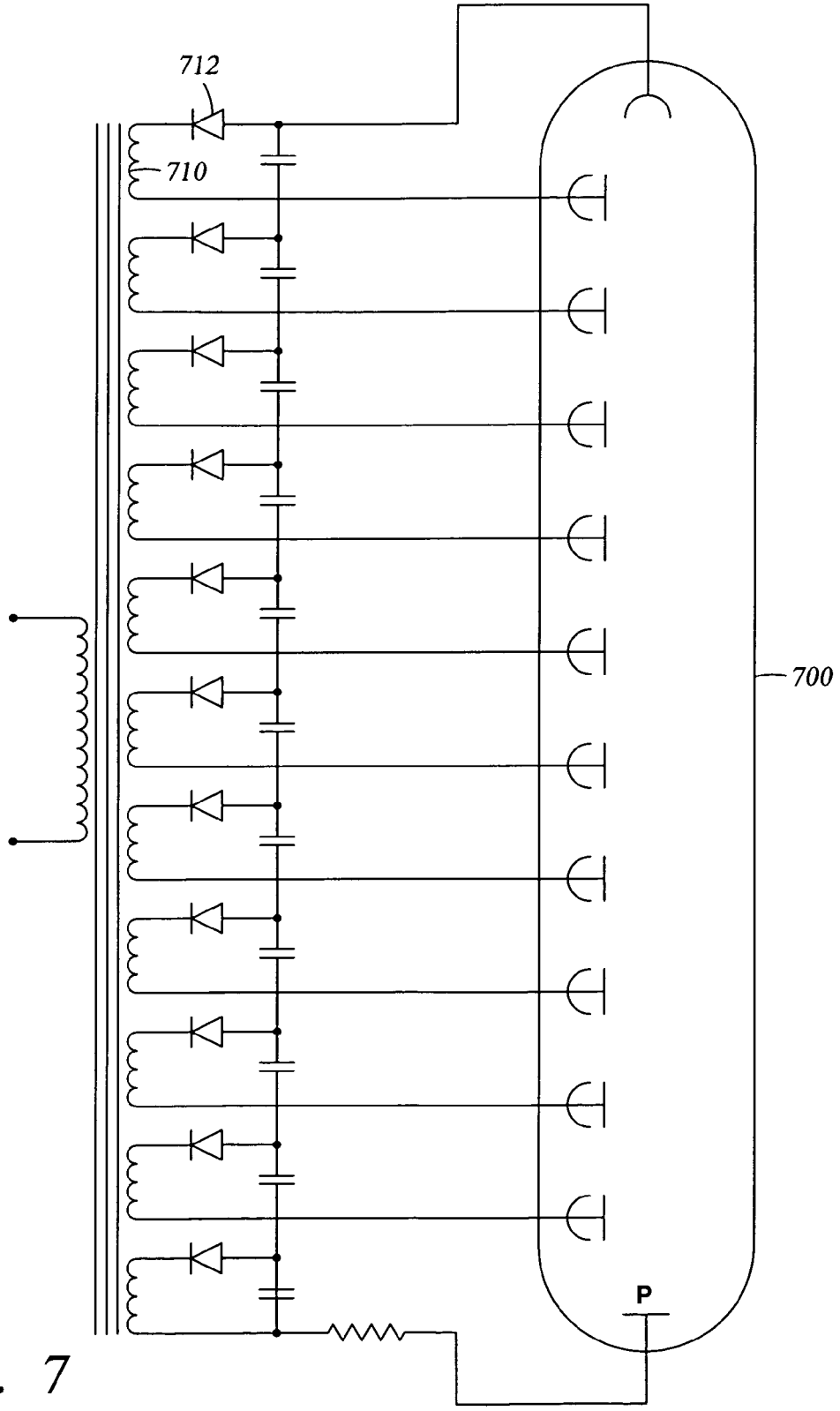
Fig. 7 (PRIOR ART)
FIG. 7 is an illustration of a known photomultiplier power supply circuit design.

Prior known methods and component circuits utilized for providing power to a photomultiplier tube are shown in FIGS. 5, 6 and 7. Turning now to FIG. 5, a typical resistor divider network 512 utilized in providing power to a photomultiplier tube 510 is shown. This is currently the most commonly used photomultiplier power supply circuit design. The disadvantages of this typical resistor divider network technique, however, are numerous. Utilizing the typical resistor divider network technique shown in FIG. 5, the photomultiplier tube gain changes at high count rates thereby skewing data and creating errors in conclusions drawn from data measurements taken. In the typical resistor divider network power is lost as heat in the resistors. Finally, the typical resistor divider network circuit requires an external power supply 514. These factors contribute to the shortcomings of the typical resistor divider network.

Figure 11:
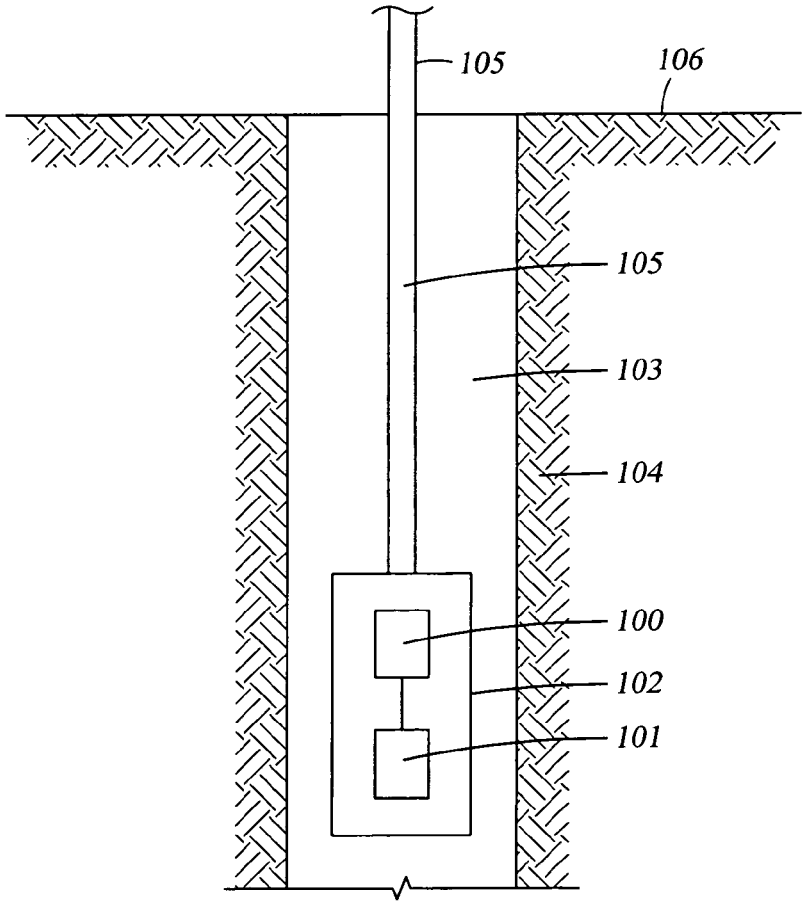
FIG. 11 is an illustration of a preferred embodiment of the present invention in operation in a high temperature down hole environment.

Turning now to FIG. 6, another known technique is illustrated. In FIG. 6, dynodes 610 are connected to a multiplier ladder 612. While the circuit is simpler than the typical resistor divider network circuit of FIG. 5, there are still significant disadvantages with the circuit design as shown in FIG. 6. In the circuit of FIG. 6, the voltage ratio changes from stage to stage, thereby providing a smaller and smaller voltage gradient as the last (most negative) stage is reached. Thus, using the circuit of FIG. 6, it is very difficult to implement ratios other than 1:1, 1:2 or 1:3. Additionally, compared to the present invention, the diodes and capacitors 614 of the circuit of FIG. 6 are almost four times in quantity, as are the losses associated with those elements, especially at high temperatures. The high temperature factor is exacerbated when using a photomultiplier 100 and photomultiplier power supply 101 in a high temperature environment such as when providing power in a down hole tool 102 deployed via a drill string or wire line 105 for determining the characteristics of a well bore 103 drilled in the earth 106, or a formation 104 surrounding a well bore when used in a down hole tool environment as shown in FIG. 11. The use of photomultiplier in such tool is well known in the art.

Figure 9:
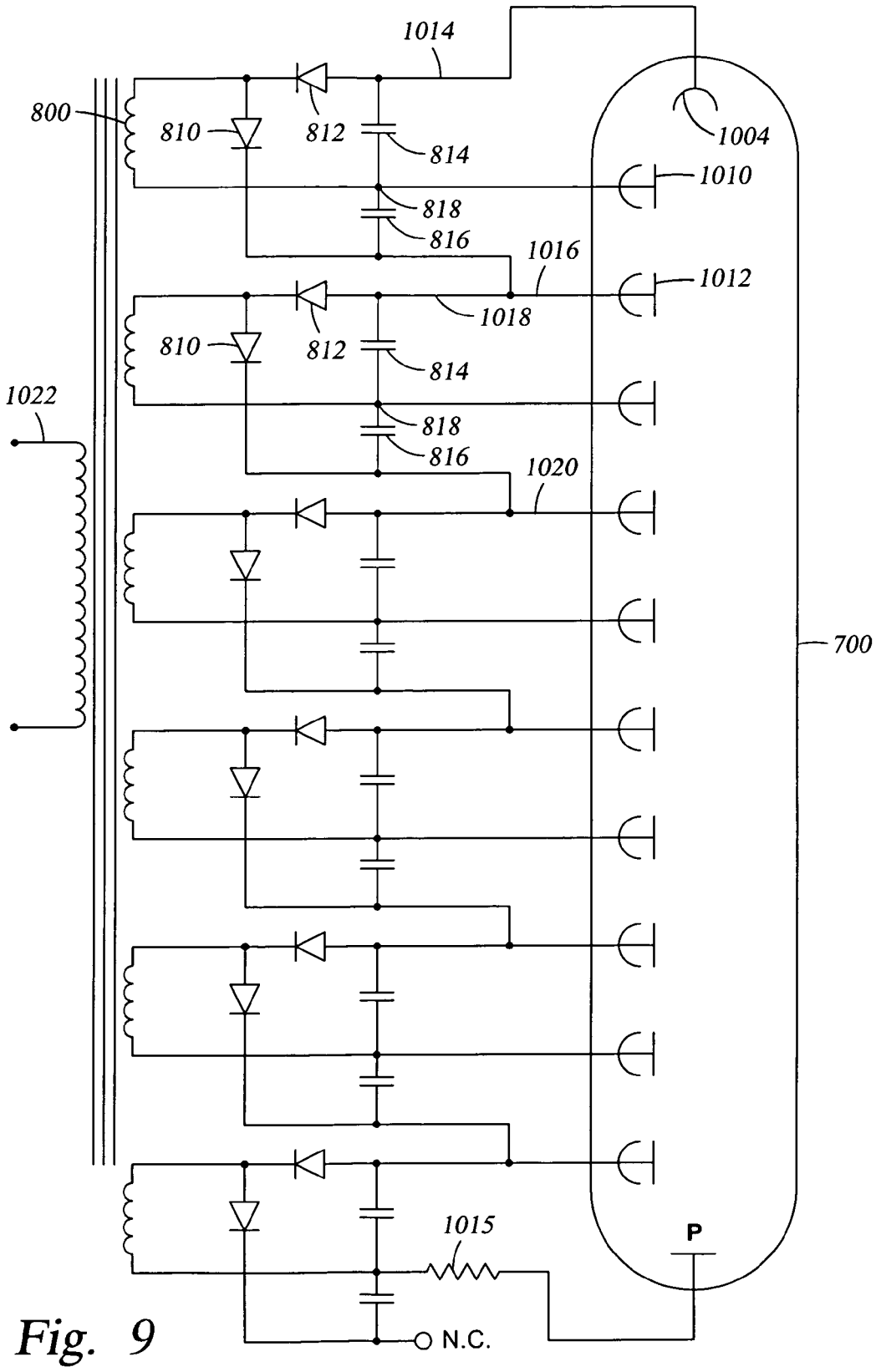
FIG. 9 is an illustration of a preferred embodiment of the present invention.

Turning now to FIG. 7, another known photomultiplier 700 power supply circuit design is illustrated, wherein the transformer design is very complex and there is a net DC field present in the transformer core. Note that in FIG. 7, there are 11 coils 710 versus the 5 coils of the preferred embodiment of the present invention as shown in FIG. 9. Additionally, there essentially twice as many dynodes 712 necessary for the known design of FIG. 7, versus the preferred embodiment of the present invention as shown in FIG. 9, discussed below.

Figure 8:
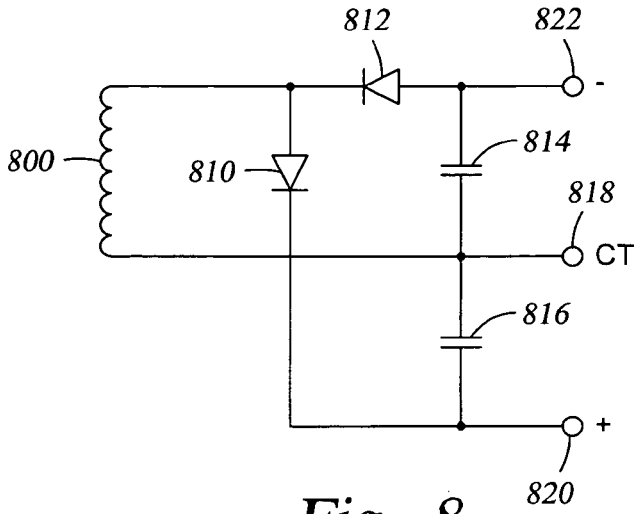
FIG. 8 is an illustration of a preferred embodiment of the present invention.

The power supply of to present invention comprises a series of basic cells to which the photomultiplier tube terminals connect. Turning now to FIG. 8, the preferred embodiment of the present invention comprises a plurality of secondary transformer windings 800 coupled to primary transformer winding 1022. These secondary windings 800 can have all the same number of turns/windings or the number of turns/windings may differ from each other as desired by the photomultiplier tube application and design.

In a preferred embodiment, two diodes 810, 812 and two capacitors 814, 816 are connected to each transformer winding as shown in FIG. 8. The positive terminal 1016 of a given cell connects to the negative terminal 1018 of the following cell. The negative terminal 1014 of the first cell is connected to the photo cathode, the first dynode to the center rap 818 (CT), and the second dynode to the positive terminal. The connection sequence is then repeated until the resistor 1015 connected in series with the anode terminal 1002 is reached. Any unused terminal in the last cell is left unconnected. To change the voltage ratio between tube elements, any dynode connection can be moved from the terminal CT 818 to the positive terminal, the winding voltage changed, or a combination of both implemented.

Figure 10:
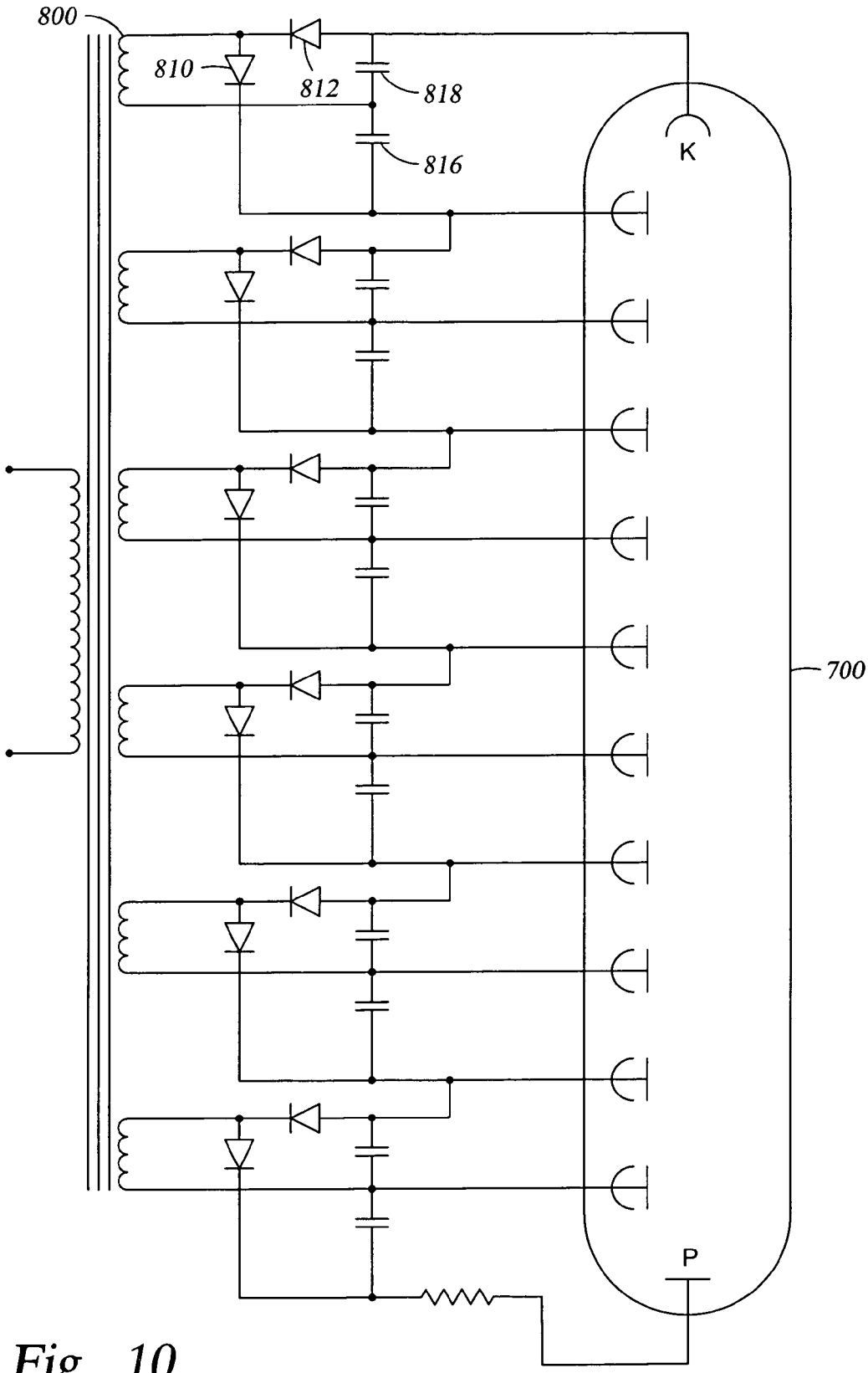
FIG. 10 is an illustration of a preferred embodiment of the present invention.

Turning now to FIG. 9, a preferred embodiment of the present invention is shown in which all windings are identical, thus all tube terminals have the same voltage gradient. Tuning now to FIG. 10, if all windings are equal, the first dynode has twice the voltage gradient. If the winding ratio is 1.5:1, then the gradient will be 3:1 instead. Anode 1016, 1020 and cathode 1014, 1018 of the first and second diode, the positive 820 and negative 822 terminals of the power supply cell, the photo cathode 1004, first 1010 and second 1012 dynodes and resistor 1015 are shown in FIG. 8 and FIG. 9.

In another embodiment of the present invention, the method of the present invention is implemented as a set computer executable of instructions on a computer readable medium, comprising ROM, RAM, CD ROM, Flash or any other computer readable medium, now known or unknown that when executed cause a computer to implement the method of the present invention.

While the foregoing disclosure is directed to the preferred embodiments of the invention various modifications will be apparent to those skilled in the art. It is intended that all variations within the scope of the appended claims be embraced by the foregoing disclosure. Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

The invention claimed is:

1. A photomultiplier power supply comprising:

(a) a primary transformer winding for receiving an input voltage;

(b) a plurality of power supply cells, wherein each cell comprises:

(c) a secondary winding coupled to the primary transformer winding;

(d) a first diode having a cathode connected to a high side of the secondary winding;

(e) a second diode having an anode connected to the high side of the secondary winding;

(f) a center tap connected to a low side of the secondary winding;

(g) a first capacitor having a first side connected to the center tap and a second side connected to an anode of the first diode;

(h) a second capacitor having a first side connected to the center tap and a second side connected to a cathode of the second diode;

(i) a positive terminal of a given cell connected to a negative terminal of a following cell;

(j) a negative terminal of a first cell connected to a photo cathode, a first center tap connected to a first dynode, and a second dynode connected to a positive terminal of the first cell; and (k) a connection pattern of connections (d) through (j) repeated until a positive terminal for a last cell is connected to a resistor connected in series with an anode terminal wherein any unused terminal in a last cell is left unconnected.

2. The power supply of claim 1 wherein a voltage ratio is changed between photomultiplier tube elements by moving a dynode connection from a center tap in a cell to a positive terminal in the cell.

3. The power supply of claim 1 wherein a voltage ratio is changed between photomultiplier tube elements by changing the number of turns in a secondary coil.

4. The power supply of claim 1 wherein a voltage ratio is changed between photomultiplier tube elements by moving a dynode connection from a center tap in a cell to a positive terminal in the cell and changing the number of turns in a secondary coil.

5. A method for providing a photomultiplier power supply comprising:

(a) coupling a primary transformer winding for receiving an input voltage to a secondary winding comprising a plurality of power supply cells;

(b) connecting a first diode having a cathode to a high side of the secondary winding;

(c) connecting a second diode having an anode connected to the high side of the secondary winding;

(d) connecting a center tap to a low side of the secondary winding;

(e) connecting a first capacitor having a first side connected to the center tap and a second side connected to an anode of the first diode;

(f) connecting a first side of a second capacitor to the center tap and connecting a second side of the second capacitor to a cathode of the second diode;

(g) connecting a positive terminal of a given cell to a negative terminal of a following cell;

(h) connecting a negative terminal of a first cell to a photo cathode, connecting a first center tap to a first dynode, and connecting a second dynode to a positive terminal of the first cell; and repeating (b) through (g) until a positive terminal for a last cell is connected to a resistor connected in series with an anode terminal; and leaving unconnected any unused terminal in a last cell.

6. The method of claim 5 further comprising:

moving a dynode connection from a center tap in a cell to a positive terminal in the cell to change a voltage ratio between photomultiplier tube elements.

7. The method of claim 5, further comprising:

changing the number of turns in secondary coil to change a voltage ratio between photomultiplier tube elements.

8. The method of claim 5, further comprising:

changing the number of turns in a secondary coil by moving a dynode connection from a center tap in a cell to a positive terminal in the cell to change a voltage ratio between tube elements.

9. A system for providing power to a photomultiplier for measuring at least one of counts and pulse heights using a down hole tool having a photomultiplier tube and photomultiplier power supply comprising:

(b) a down hole tool for traversing a well bore formed in the earth, the tool further comprising;

(c) a photomultiplier tube;

(d) a photomultiplier power supply comprising a primary transformer winding for receiving an input voltage;

(e) a plurality of power supply cells, wherein each cell comprises:

(f) a secondary winding coupled to the primary winding;

(g) a first diode having a cathode connected to a high side of the secondary winding;

(h) a second diode having an anode connected to the high side of the secondary winding;

(i) a center tap connected to a low side of the secondary winding;

(j) a first capacitor having a first side connected to the center tap and a second side connected to the anode of the first diode;

(k) a second capacitor having a first side connected to the center tap and a second side connected to a cathode of the second diode;

(l) a positive terminal of a given cell connected to a negative terminal of a following cell;

(m) a negative terminal of a first cell connected to a photo cathode, a first center tap connected to a first dynode, and a second dynode connected to a positive terminal of a first cell; and (n) series repeated until a resistor connected in series with an anode terminal is reached wherein any unused terminal in a last cell is left unconnected.

10. The system of claim 9 wherein a voltage ratio is changed between photomultiplier tube elements by moving a dynode connection from a center tap in a cell to a positive terminal in the cell.

11. The system of claim 9 wherein a voltage ratio is changed between photomultiplier tube elements by changing the number of turns in a secondary coil.

12. The system of claim 9 wherein a voltage ratio is changed between photomultiplier tube elements by moving a dynode connection from a center tap in a cell to a positive terminal in the cell and changing the number of turns in a secondary coil.

13. A method for providing power to a photomultiplier in a down hole tool having a photomultiplier tube and photomultiplier power supply comprising:

(a) traversing a well bore formed in the earth, with a down hole tool, the tool further comprising a photomultiplier tube;

(b) providing power to the photomultiplier further comprising, (c) coupling a primary transformer winding for receiving an input voltage to a secondary winding comprising a plurality of power supply cells;

(d) connecting a first diode having a cathode to a high side of the secondary winding;

(e) connecting a second diode having an anode to the high side of the secondary winding;

(f) connecting a center tap connected to a low side of the secondary winding;

(g) connecting a first capacitor having a first side connected to the center tap and a second side connected to an anode of the first diode;

(h) connecting a first side of a second capacitor to the center tap and connecting a second side of the second capacitor to a cathode of the second diode;

connecting a positive terminal of a given cell to a negative terminal of a following cell;

(i) connecting a negative terminal of a first cell to a photo cathode, connecting a first center tap to a first dynode, and connecting a second dynode to a positive terminal of the first cell; and (j) repeating a connection series until a resistor connected in series with an anode terminal is reached; and (k) leaving unconnected any unused terminal in a last cell.

14. The method of claim 13 further comprising:

moving a dynode connection from a center tap in a cell to a positive terminal in the cell to change a voltage ratio between photomultiplier tube elements.

15. The method of claim 13, further comprising:

changing the number of turns in a secondary coil to change a voltage ratio between photomultiplier tube elements.

16. The method of claim 13, further comprising:

changing the number of turns in a secondary coil by moving a dynode connection from a center tap in a cell to a positive terminal in the cell to change a voltage ratio between photomultiplier tube elements.

* * * * *